US005687593A

United States Patent [19]

Cross

[11] Patent Number: 5,687,593

[45] Date of Patent: Nov. 18, 1997

[54] HANDCUFFS

[75] Inventor: Geoffrey William Cross, Pedmore, England

[73] Assignee: Hiatt and Company Limited, United Kingdom

[21] Appl. No.: 501,585

[22] Filed: Jul. 12, 1995

[30] Foreign Application Priority Data

Jun. 1, 1995 [GB] United Kingdom ..... 9511068

[51] Int. Cl.[6] ..... E05B 75/00

[52] U.S. Cl. ..... 70/16; 70/14; 70/15; 119/819

[58] Field of Search ..... 70/15, 17, 18, 70/91, 14, 16; 119/816, 819; 16/319, 321, 324, 325, 333

[56] References Cited

U.S. PATENT DOCUMENTS

| | | | |
|---|---|---|---|
| 1,440,713 | 1/1923 | Ausborne | 16/324 |
| 1,881,577 | 10/1932 | Hillyard | 70/16 |
| 2,966,787 | 1/1961 | Tompkins | 70/16 |
| 3,448,486 | 6/1969 | Wright | 16/324 |
| 3,613,665 | 10/1971 | Rosenthal | 70/16 |
| 3,618,345 | 11/1971 | Smith | 70/16 |
| 3,711,894 | 1/1973 | Walters | 16/144 |
| 3,740,977 | 6/1973 | Stefansen et al. | 70/16 |
| 3,899,905 | 8/1975 | Walters | 70/91 |
| 4,089,195 | 5/1978 | Lai | 70/16 |
| 4,138,867 | 2/1979 | Tompkins | 70/16 |
| 4,162,622 | 7/1979 | Daleo | 70/16 |
| 4,300,368 | 11/1981 | Sullivan | 70/16 |
| 4,697,441 | 10/1987 | Allen | 70/16 |
| 5,007,257 | 4/1991 | Thompson | 70/16 |
| 5,205,142 | 4/1993 | Kruger et al. | 70/16 |
| 5,461,890 | 10/1995 | LeFavor | 70/16 |

FOREIGN PATENT DOCUMENTS

| | | | |
|---|---|---|---|
| 6808902 | 12/1969 | Netherlands | 70/16 |
| 171637 | 9/1934 | Switzerland | 70/16 |
| 2 283 784 | 5/1995 | United Kingdom . | |

*Primary Examiner*—Steven N. Meyers
*Assistant Examiner*—Tuyet-Phuong Pham
*Attorney, Agent, or Firm*—Kirschstein, et al.

[57] ABSTRACT

A handcuff comprises a pair of lockable bracelet members (10, 11), pivotably connected to one another by way of a connecting member (12) wherein is disposed a catch member (29) engagable with the bracelet members to hold them relative to one another in an extended position so that the handcuff may be used as a rigid handcuff, the catch member being disengagable from the bracelet members to enable the handcuff to be folded.

6 Claims, 2 Drawing Sheets

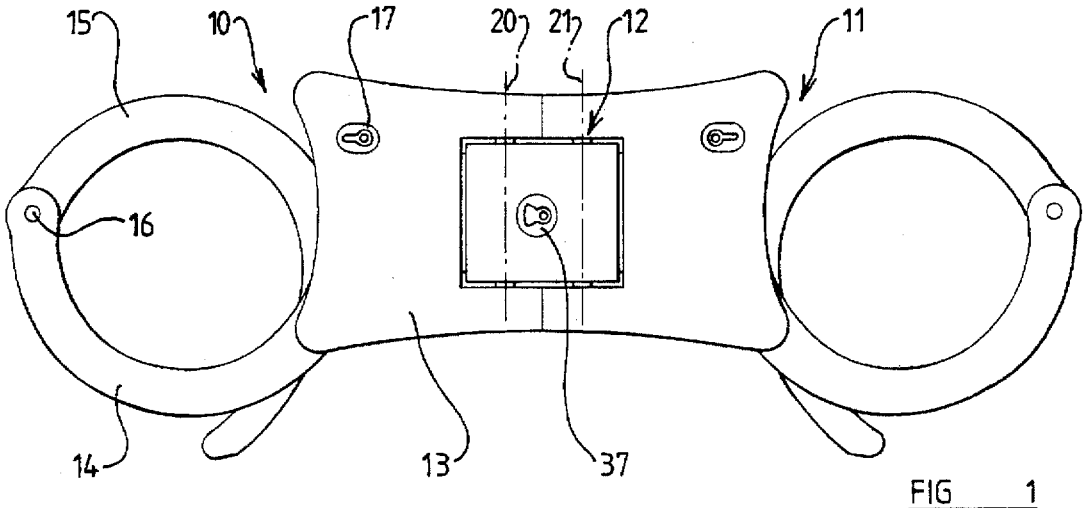
FIG 1
FIG 2
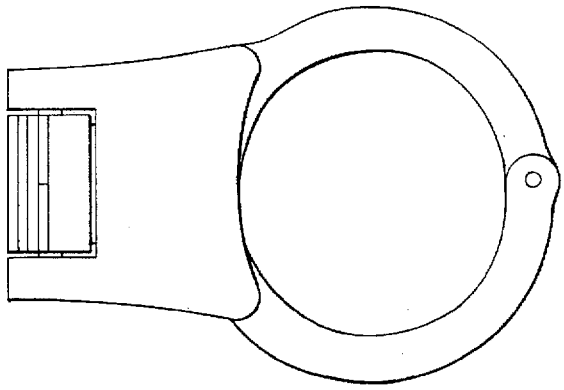
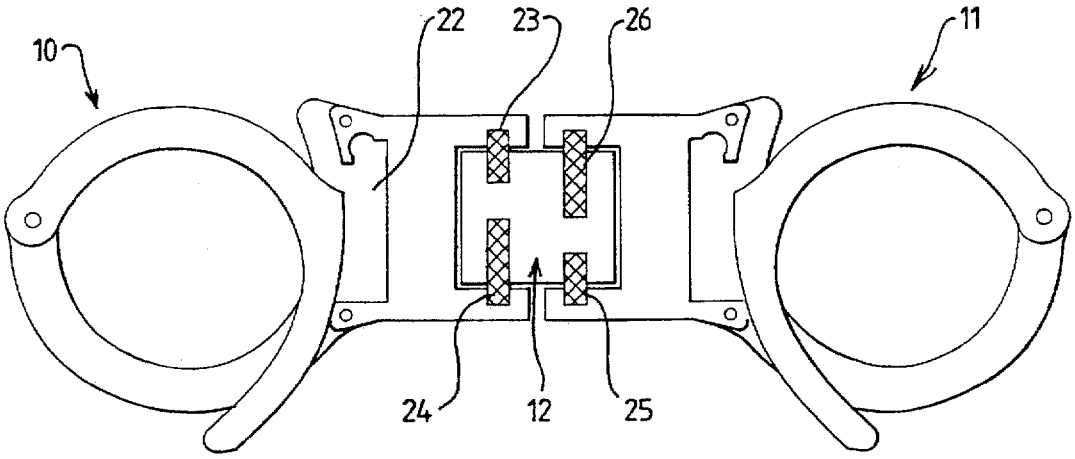
FIG 3

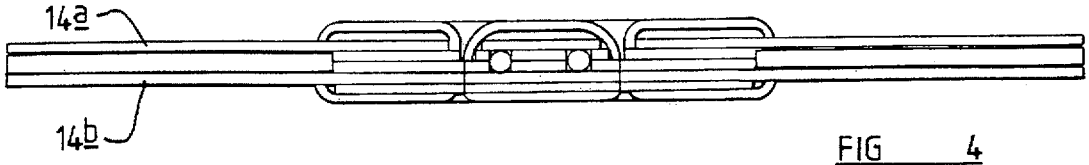
FIG 4
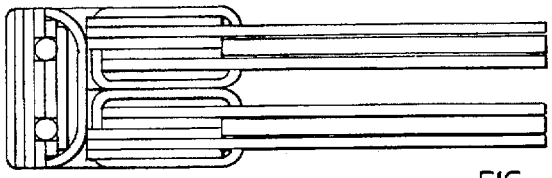
FIG 5
FIG 6
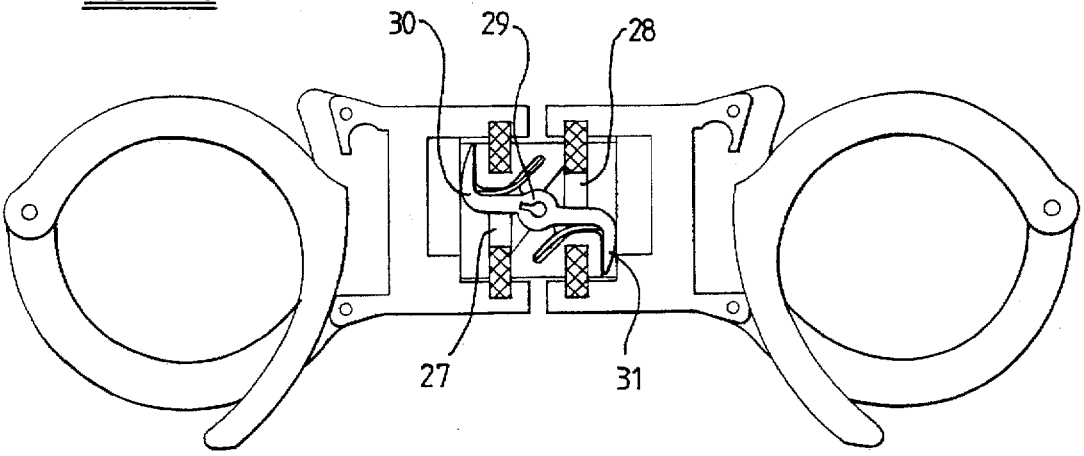
FIG 7
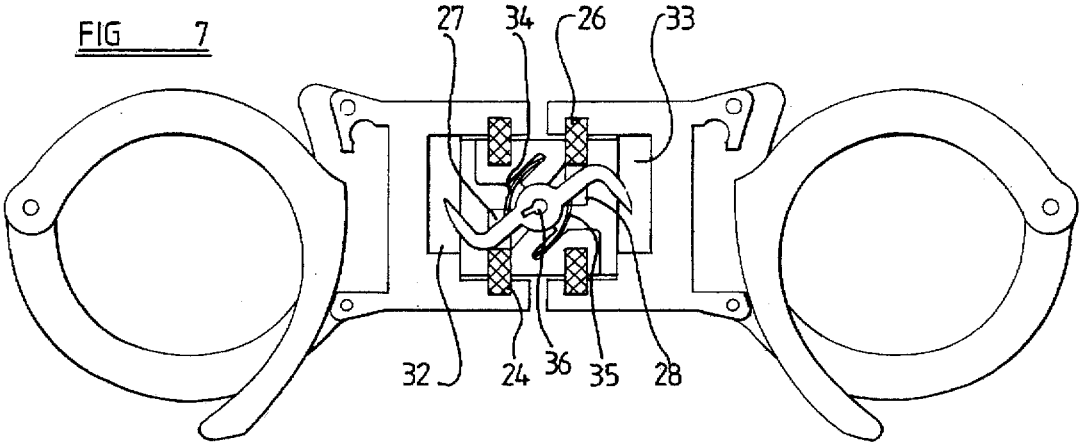

HANDCUFFS

BACKGROUND TO THE INVENTION

1. Field of the Invention

This invention relates to handcuffs, of the type comprising a pair of lockable bracelet members engagable with the wrists of a person being restrained, and means connecting the bracelet members together.

2. Description of Prior Art

Handcuffs are known (e.g. U.S. Pat. No. 5,233,848) wherein the means connecting the bracelet members together does so rigidly. Also known and widely used is a chain type of handcuff wherein the two lockable bracelet members are non-rigidly connected to one another by a chain. It is known (e.g. U.S. Pat. No. 4,840,848, U.S. Pat. No. 5,007,257) to rigidify a chain type of handcuff by a cover over the chain and part of the bracelet members, but then the handcuff is functionally equivalent to a rigid handcuff. Yet another type of handcuff which has been extensively utilized is a hinged type, wherein the two bracelet members are hingedly connected together about one or more pivot axes, permitting the members to be pivoted from an extended configuration to a folded configuration in which latter configuration the bracelet members overlie one another. Such non-rigid handcuffs when in their folded position occupy much less space than when they are in their extended configuration, to facilitate carrying thereof, but are not as easy to use, and in particular to apply to a person being restrained, as a rigid handcuff. It has been proposed (e.g. GB 2 283 784) to rigidify a hinged handcuff by the application of a cover to a part thereof including the hinge mechanism, but then the advantage of being able to fold the handcuff is lost.

SUMMARY OF THE INVENTION

It is broadly an object of the present invention to provide a handcuff in which this disadvantage is reduced.

According to the present invention, we provide a handcuff comprising a pair of lockable bracelet members; means pivotably connecting said bracelet members together so that they are movable relative to one another about at least one pivot axis between an extended position for use and a folded position in which the bracelet members overlie one another; and releasable catch means operable to retain said bracelet members in said extended position.

A handcuff in accordance with the invention has the advantage of being able to assume its folded position and thereby occupy a minimum amount of space when not in use, but is made rigid, and thus is as easy to use as a rigid handcuff when the catch means holds the bracelet members in their extended position.

Preferably the catch means is resiliently biased into a retaining position in which it is able to retain said bracelet members in said extended position.

By virtue of such a resiliently biased catch means, it is possible to arrange the handcuff so that the catch means operates automatically when the bracelet members reach their extended position to retain them in such a position. The handcuff is able to be extended from its folding position and then used as a rigid handcuff without any action on the part of the user to cause the catch means to retain the bracelet members in the extended position.

The bracelet members may be movable relative to one another about two pivot axes which are parallel to one another, and conveniently this may be achieved by providing a connecting member to which the bracelet members are pivotably connected about respective pivotal axes. Preferably the catch means is provided in, or associated with, said connecting member and is engagable with the two bracelet members to retain the bracelet members in their extended position relative to the connecting member.

The catch means may comprise a catch member movably mounted within the connecting member and having formations engagable respectively with the bracelet members.

Preferably the catch member is mounted for angular movement within the connecting member between a first position wherein its formations are retracted within the connecting member and its retaining position wherein its formations extend outwardly therefrom to engage the bracelet members.

The catch member may be spring biased to move angularly towards its retaining position and be movable by a key in the opposite sense.

Then, whilst as above described the handcuff is extendable from its folding position and is then automatically retained in its extended position, without the use of any tool or implement by the user, use of the key is necessary when the handcuff is to be folded from its extended position.

Preferably there is means for preventing the catch member from moving to its retaining position unless the bracelet members are in their extended position. Such means may be constituted by a pivot pin by which a bracelet member is pivotably connected to the connecting member, such pivot pin being rotationally fast with the bracelet member and moving angularly relative to the connecting member with the bracelet member, the pivot pin having a relieved portion which permits the movement of the catch member when the bracelet member is in its extended position relative to the connecting member.

BRIEF DESCRIPTION OF THE DRAWINGS

These and other aspects of the invention will now be described by way of example with reference to the accompanying drawings, of which:

FIG. 1 is a plan view of a handcuff according to the present invention, in the extended condition;

FIG. 2 is a view as FIG. 1 but with the handcuff in the folded condition;

FIG. 3 is a view as FIG. 1 but showing part of the internal construction of the handcuff;

FIGS. 4 and 5 are elevational views of the handcuff, respectively in extended and folded condition;

FIGS. 6 and 7 are yet further views as FIG. 3, but showing yet further detail of the construction of the handcuff.

DESCRIPTION OF PREFERRED EMBODIMENTS

Referring firstly to FIG. 1 of the drawing, a handcuff comprises two bracelet members indicated generally at 10, 11 connected to one another by connecting means indicated generally at 12. The bracelet member 10 comprises a body portion 13 from which an arcuate limb 14 extends. The limb 14 comprises two spaced limb portions 14*a*, 14*b* and at the free end of the limb an arcuate clasp member 15 is secured for rotation about a rivet 16. The clasp member 15 lies between the limb portions 14*a*, 14*b*, so that the limb 15 is able to rotate through a full 360° passing between the limb portions 14*a*, 14*b*. On its outer surface remote from its pivot 16 the clasp member 15 carries ratchet teeth or like formations engagable with a lock mechanism carried within the body 13 of the bracelet member 10: such a locking mechanism is not herein described as it is conventional. The ratchet teeth enable the clasp member 15 to be angularly moved in the clockwise direction with reference to the drawing to apply it to the wrist of a person who is to be restrained and prevent movement of the clasp member in the opposite direction. When thus applied to the wrist of the person the position of the clasp member 15 will be somewhat as that illustrated but the exact position will depend on the size of the person's wrist. FIG. 1 shows a keyhole 17 for receiving a key to release the lock mechanism and permit the clasp member 15 to be pivoted anticlockwise to release the wrist of a restrained person.

The bracelet member 11 is of the same construction as the bracelet member 10 being a mirror image thereof, and will not be described in detail.

The bracelet members 10, 11 are pivotably connected to the connecting member 12 for pivotal movement about respective pivot axes indicated at 20, 21 in FIG. 1. By pivoting each of the bracelet members through 90° about the respective axis 20, 21 relative to the connecting member 12 the handcuff is able to assume a folded condition as shown in FIG. 2, wherein the bracelet members 10, 11 overlie one another.

The bracelet members 10, 11, and the connecting member 12, are each of laminated construction comprising a number of metal plates overlying one another and held together by through-rivets. Such laminated construction is shown in FIGS. 4 and 5. The limbs 14*a*, 14*b* of the bracelet member 10, as above described, are extensions of two such metal plates which are spaced from one another. As shown in FIG. 3, certain such plates are cut out to define a space in the body of each bracelet member, as indicated at 22 for the bracelet member 10, to accommodate the lock mechanism above referred to. Outermost ones of such plates, or possibly covers e.g. of plastics material on such plates, may be shaped to provide a comfortable and manipulable grip for a person using the handcuff to apply it to a person being restrained.

FIG. 3 also shows pivot pins 23, 24 by which the bracelet member 10 is connected to the connecting member 12, and corresponding pivot pins 25, 26 by which the bracelet member 11 is connected to the connecting member 12. The pivot pins 23 to 26 lie in recesses cut into appropriate ones of the laminated metal plates forming the connecting member and each bracelet member; the parts of the pivot pins which are received in the bracelet members are of square cross-sectional shape so that they are prevented from rotating relative to the bracelet members. The parts of the pivot pins 23, 25 received in the connecting member 12 are circular in cross-section whilst the parts of the pins 24, 26 received in the connecting member 12 are circular but with flats 27, 28 respectively formed thereon for the purpose hereafter described. When the bracelet members of the handcuff are pivotally moved between their folded and extended positions, the pivot pins 23 to 26 pivot within the connecting member 12.

Within the connecting member 12 a catch member 29 is supported for angular movement. The catch member 29 is somewhat S-shaped in plan view and its opposite ends comprise catch formations 30, 31. When the handcuff is in its extended configuration, the catch formations 30, 31 are able, upon angular movement of the catch member in the anti-clockwise sense, to enter respective recesses 32, 33 in the body part of each bracelet member 10, 11, and when the catch formations have thus entered the recesses the bracelet members are retained in the extended condition.

The catch member 29 is spring biased to move in the anticlockwise sense, towards its retaining position as above described, by a pair of leaf spring elements 34, 35 which are held in the connecting member 12 and abut the catch member 29. For moving the catch member against its spring biasing away from its retaining position, the catch member has a formation 36 engagable by a key inserted through a keyhole 37 in the connecting member.

It will be noted that when the catch member is in its retaining position as shown in FIG. 7 its opposed parts overlie the flats 27, 28 on the pivot pins 24, 26. The flats 27, 28 are arranged so that the catch member is able to assume its retaining position only when the bracelet members are in their fully extended positions. In all other positions of the bracelet members, the catch member is retained in the position in which it is illustrated in FIG. 6. When, after use, the handcuff is to be returned to its folded condition, movement of the catch member to remove its catch formations 30, 31 from the recesses 32, 33 in the bracelet members also clears the catch members from the pivot pins 24, 26, enabling folding of the handcuff.

Thus a handcuff according to the invention is convenient in use. It can be carried in the folded condition, and when extended the catch means engages automatically to retain it in the extended condition. The handcuff can then be used as a conventional rigid handcuff. Use of a key to release the catch member is required when, after use, the handcuff is required to be folded again.

It will be appreciated that modifications may be made from the embodiment above described without departing from the scope of the present invention. As shown in FIG. 1, the body parts of the bracelet members may be provided with coverings, e.g. of plastics material, to afford a comfortable shape to the user.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilized for realising the invention in diverse forms thereof.

I claim:

1. A handcuff comprising:

a pair of lockable bracelet members;

a connecting member;

two pivot means providing pivotal connection of the pair of bracelet members to the connecting member about respective pivot axes, said bracelet members being movable relative to one another between an extended position for use and a folded position in which the bracelet members overlie one another;

a catch member having formations engageable with the pair of bracelet members for retaining the bracelet members in said extended position relative to the connecting member; and means movably mounting the catch member in the connecting member.

2. The handcuff according to claim 1, wherein said pivot axes are parallel to one another.

3. The handcuff according to claim 1, wherein said means movably mounting the catch member provides for angular movement of the catch member within the connecting member, between a first position wherein said formations of the catch member are retracted within the connecting member and a second, retaining, position wherein said formations extend outwardly from the connecting member to engage the bracelet members.

4. The handcuff according to claim 3 and further comprising means for spring biasing the catch member to move angularly towards said retaining position, and means engageable by a key for moving the catch member in the opposite direction.

5. The handcuff according to claim 4, and further comprising means for preventing the catch means from moving to said retaining position unless the bracelet members are in their extended position.

6. The handcuff according to claim 5, wherein said means for preventing the catch means from moving comprises a pivot pin defining a said pivotal connection for each bracelet member and being rotationally fast with the respective bracelet member, said pivot pin having a relieved portion cooperating with the catch means to permit the movement of the catch means when the respective bracelet member is in its extended position.

* * * * *